United States Patent [19]

Bartus et al.

[11] Patent Number: 4,730,738

[45] Date of Patent: Mar. 15, 1988

[54] ADJUSTABLY TILTABLE WALL SHELF ASSEMBLY

[75] Inventors: John Bartus, Poquonock; Vincent Dicioccio, Rocky Hill, both of Conn.

[73] Assignee: United Plastic Technologies, Inc., New Britain, Conn.

[21] Appl. No.: 915,765

[22] Filed: Oct. 6, 1986

[51] Int. Cl.[4] ..... A47F 5/08

[52] U.S. Cl. ..... 211/90; 248/242; 211/150

[58] Field of Search ..... 211/150, 149, 90, 169.1, 211/170, 81, 96, 147; 248/242, 241; 108/108, 6

[56] References Cited

U.S. PATENT DOCUMENTS

| | | | |
|---|---|---|---|
| 306,335 | 9/1984 | Higley . | |
| 350,031 | 8/1986 | Bacon . | |
| 749,670 | 1/1904 | Gardner . | |
| 782,069 | 2/1905 | Sjöstrom | 248/242 |
| 855,354 | 5/1907 | Soucey . | |
| 945,280 | 1/1910 | Lindberg | 248/242 |
| 1,232,874 | 7/1917 | Whealen . | |
| 1,805,989 | 5/1931 | Levene | 248/242 X |
| 1,852,723 | 4/1932 | Orton et al. . | |
| 2,483,758 | 10/1949 | Douglas . | |
| 2,906,486 | 9/1959 | Bellon et al. . | |
| 2,963,254 | 12/1960 | Rodgers . | |
| 3,080,980 | 3/1963 | Gibbons | 248/242 X |
| 3,151,576 | 10/1964 | Patterson | 248/242 X |
| 3,463,433 | 8/1969 | Stein et al. | 248/242 |
| 3,485,382 | 12/1969 | Larson . | |
| 3,561,713 | 2/1971 | Berkowitz | 248/242 |
| 3,795,379 | 3/1974 | Gray | 248/242 |
| 4,065,088 | 12/1977 | Shell | 248/242 |
| 4,552,272 | 12/1985 | Field . | |

FOREIGN PATENT DOCUMENTS

| | | | |
|---|---|---|---|
| 698986 | 12/1964 | Canada | 248/242 |
| 176921 | 10/1961 | Sweden | 248/242 |
| 1353957 | 5/1974 | United Kingdom | 248/242 |

*Primary Examiner*—Ramon S. Britts
*Assistant Examiner*—Sarah A. Lechok Eley

[57] ABSTRACT

A shelf system utilizes a hingedly mounted shelf, and an assembly including a brace piece having a back portion contoured to provide elements disposed progressively inwardly with respect to a vertical axis. Securing the brace piece at any of several transverse positions on the shelf, relative to the vertical reference, will vary the angular attitude of the shelf; normally, the vertical reference will be the wall to which the shelf is attached and against which the contacting element of the brace piece will rest for supporting the shelf.

15 Claims, 6 Drawing Figures

ADJUSTABLY TILTABLE WALL SHELF ASSEMBLY

BACKGROUND OF THE INVENTION

Many forms of bracket arrangements have been proposed in the art for supporting a shelf, or the like, selectively within in a range of angular orientations. Typical are the disclosures of the following United States Patents:

Higley U.S. Pat. No. 306,335 provides a system in which pairs of brackets are affixed to a wall portion; the shelf component is pivoted at one end to the upper brackets and, at its opposite end, to diagonal braces which are, in turn, pivoted to the lower brackets.

A shelf bracket is shown in U.S. Pat. No. 350,031, to Bacon, which consist of a vertical leg, a laterally extending arm, or shelf support, pivoted to the top of the vertical leg, and a diagonal brace pivoted to the bottom; the upper end of the brace fits into each of a number of apertures in the shelf support, to change its angular orientation.

Gardner U.S. Pat. No. 749,670 shows a bracket which employs a wall-mounted vertical support and a slotted lateral support, the latter having a series of apertures spaced along its length. A diagonal brace is pivoted to the vertical support, and has a locking pin at its outer end for selective engagement in any of the spaced apertures, thereby enabling variation of the angular orientation of the laterally extending support.

The bracket provided in Soucey U.S. Pat. No. 855,354 consists of a wall plate hinged to a shelf plate; each plate has an integral brace section of arcuate form, the free ends of which overlap for interengagement in a range of selected positions, so as to vary the orientation of the shelf plate.

The adjustable bracket shown in Lindberg U.S. Pat. No. 945,280 consists of a mounting piece and a shelf-supporting piece, the latter having an arcuately arranged series of apertures for receipt of a removable pin, with orientation of the supporting piece being dependent upon which of the apertures is engaged.

Whealen U.S. Pat. No. 1,232,874 employs wall-mounted stanchions and shelf-supporting elements secured thereto; a diagonal brace is pivotably mounted at one end in any of the aperatures provided in the flange of the shelf supporting element, and is engaged at the other end in any of the apertures of the stanchion, for selective positioning of the shelf.

Orton et al U.S. Pat. No. 1,852,723 discloses a collapsible table arrangement in which a diagonal brace serves to support the table, which is pivotably mounted to wall structure by suitable brackets.

In Douglas U.S. Pat. No. 2,483,758, an adjustable shelf bracket is shown in which the opposite ends of a strut are attached to blocks, which are slidably connected to hinged elongated members; the strut can be locked in each of a range of positions on the hinged members.

The shelf support assembly described in Bellon et al U.S. Pat. No. 2,906,486 employs wall-mounted stanchions, which carry laterally extending shelf support elements. A diagonal brace extends downwardly from a flange on the shelf support element, and can be affixed at different points on the stanchion to vary the angular orientation of the shelf; an outer portion of the brace has an edge configuration consisting of straight and curved elements.

Rodgers U.S. Pat. No. 2,963,254 shows a collapsible barrel rack in which horizontal arms are hinged at one end to a wall-mounted bracket, and are supported at their outer ends by a pair of legs, the latter extending diagonally to seat within a lower support bracket.

Larson U.S. Pat. No. 3,485,382 discloses an arrangement in which a first pair of brackets carry elongated shelf-support arms, and a second pair thereof serve to support the lower ends of diagonal braces which are pivoted to the arms; selective placement of the brackets on a pegboard determines the angular orientation of the shelf.

A plastic display bin is shown in Field U.S. Pat. No. 4,552,272, which is carried by shelf-mounting elements secured on stanchions; components of the mounting brackets are pivotably connected to one another, and are capable of being fixed in different relative positions so as to vary the angular orientation of the supported bin.

Despite the level of activity in the art evidenced by the foregoing, a need remains for an uncomplicated and yet effective assembly by which a shelf or the like can readily be disposed in each of a number of different angular orientations, and it is therefore a broad object of the present invention to provide the same.

It is a more specific object of the invention to provide such an assembly comprised of only a few pieces of uncomplicated construction, which are readily adjusted with respect to one another to provide secure support in each of a multiplicity of positions.

Additional objects are to provide a novel wall shelf system which employs an assembly having the above-described features and advantages, which system is of simple construction and is yet highly effective and secure.

Further objects of the invention are to provide such an assembly and system which are relatively facile and inexpensive to manufacture.

SUMMARY OF THE DISCLOSURE

It has now been found that certain of the foregoing and related objects of the present invention are attained by the provision of an assembly which is comprised of a brace piece, a mounting piece, and means for disengageably affixing them together. The brace piece has an upper portion with a substantially rectilinear top face that extends along a first axis, and a back portion with a contoured end face which has an upper element that is outermost on the piece and that lies adjacent the "first" axis on a second axis that is perpendicular to it. The end face also incorporates a plurality of lower elements, below the "upper" element and spaced inwardly from the "second" axis by distances that increase progressively with the distance that the particular element lies from the "first" axis. The mounting piece engages the upper portion of the brace piece in each of a multiplicity of relative positions along its top face, and the affixing means disengageably secures the pieces to one another in each such position.

In the preferred embodiments, the upper element of the contoured end face will be elongated and will extend substantially rectilinearally along the "second" axis, with the top face and the upper element intersecting one another to form a right-angle section on the brace piece. Most desirably, the end face will also include a curvilinear section by which the lower elements are provided.

A multiplicity of apertures may be formed through the upper portion of the brace piece along its top face, and the mounting piece may have an element adapted for slidably engaging the top face; it will also have elements which cooperate with the apertures of the brace piece for securing them in their relative positions. The securing elements of the mounting piece will advantageously comprise spaced flange elements which project from the top face-engaging element and define a channel in which the upper portion of the brace piece is slidably seated. Such flange elements will normally have apertures which are located to align with each of the apertures of the brace piece, in which case the affixing means will comprise a fastener having a shank adapted to extend through the aligned apertures. The mounting piece will most desirably comprise an elongated channel member of generally U-shaped cross section.

In one specific form, the shank of the fastener used to affix the pieces together will have an enlarged section along its length, which is resiliently compressable so as to enable its effective external cross sectional dimensions to be reduced. In its uncompressed state, the enlarged section will have a cross sectional dimension that is larger than that of the apertures of the brace piece and/or of the flange elements of the mounting piece, so as to enable frictional interengagement therewith. The shank may be hollow along a portion of its length, and a head may be provided an one end, spaced from the enlarged section, so as to provide a particularly effective fastener component.

Other objects of the invention are achieved by the provision of a wall shelf system which includes a plurality of supporting assemblies, as hereinabove described, disposed at laterally spaced locations on the shelf. In those instances, the mounting piece of each supporting assembly will usually be secured to a bottom surface of the shelf. The shelf itself may comprise a main panel portion and a ledge portion that extends upwardly along a first edge thereof, and the main panel portion may have a second, generally rectilinear edge spaced from the first (which normally will also be rectilinear) and substantially parallel to it. The system may additionally include means adjacent the second edge of the panel portion for attachment to a wall, and generally such means will include at least one hinge member having an element that is secured to the panel portion of the shelf. The attachment means will usually also include an elongated mounting member extending along the second edge of the panel portion, which is adapted for direct attachment to the wall and which has a cooperating hinge element secured to it.

DETAILED DESCRIPTION OF THE ILLUSTRATED EMBODIMENTS

Figures 1, 2, 3:
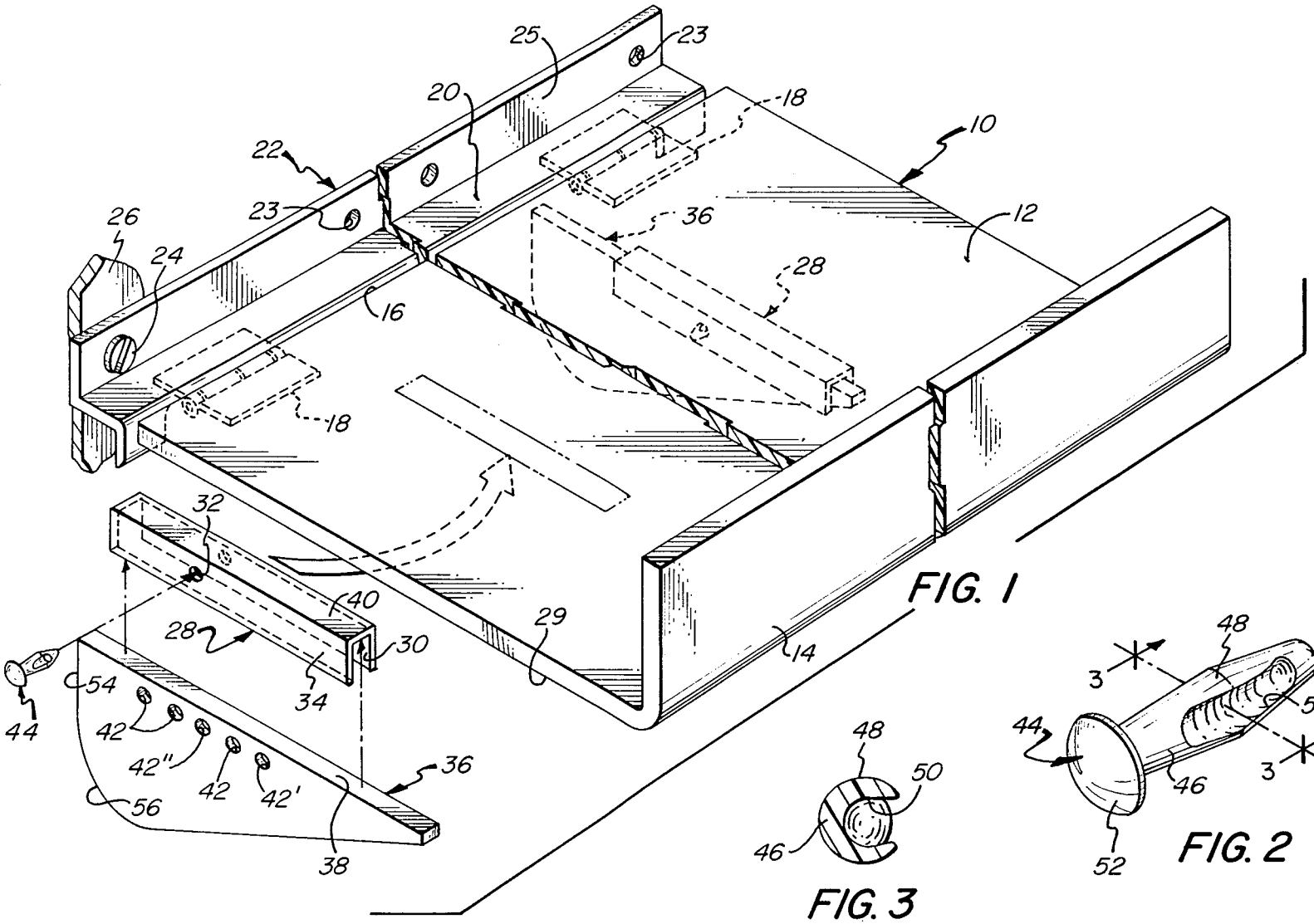
FIG. 1 is a fragmentary perspective view of a shelf system embodying the present invention.
FIG. 2 is a perspective view of a fastener utilized for affixing the bracket and mounting pieces of the system to one another, drawn to a scale greatly enlarged from that of FIG. 1.
FIG. 3 is a sectional view of the fastener of FIG. 2, taken along line 3—3 thereof.

Turning now in detail to the FIGS. 1–5 of the appended drawings, therein illustrated is a system embodying the present invention, including an L-shaped shelf, generally designated by the numeral 10. The shelf 10 consists of a main body portion 12 having a ledge portion 14 along its forward edge and at a right-angle thereto, and having a parallel rectilinear rear edge 16. One element of each of a pair of hinges 18 is secured to the body portion 12 along the edge 16, the other hinge element being attached to one leg 20 of a right-angle member, generally designated by the numeral 22; attachment may be made on top of the leg 20, if so desired. The member 22 is, in this embodiment, secured to the vertical wall 26 by nut and bolt fasteners 24 (only one of which is shown), which pass through holes 23 in the perpendicular leg 25 thereof.

A pair of U-shaped channel pieces, generally designated by the numeral 28, are secured on the bottom surface 29 of the main body portion 12 of the shelf 10, and provide mounting pieces. They are spaced laterally from one another and equidistantly from the rear edge 16, and they are oriented with their channels 30 parallel to one another and perpendicular to the edge 16. A pair of aligned apertures 32 are formed through the lateral wall elements 34 of each channel piece 28.

Assembled with each of the channel pieces 28 is a brace piece, generally designated by the numeral 36. The brace pieces are virtually identical, and each has a rectilinear upper edge portion, with a top face 38, which is slidably engaged within the channel 30 defined by the lateral and upper walls 34, 40, respectively, of the associated piece 28. A series of five apertures 42 are equidistantly spaced along an axis parallel to the top face 38; although perhaps not evident from the drawings, the apertures 42 are slightly smaller in diameter than are the apertures 32 of the channel pieces 28. The respective apertures 32, 42 are disposed to align with one another when the brace piece 36 is properly seated within the channel 30 of the associated channel piece 28, so as to permit insertion of one of the snap-rivet fasteners, generally designated by the numeral 44, therethrough. This of course serves to interengage the pieces and to maintain them in assembly in each of five relative positions.

The fasteners 44 include a shank portion 46, which is of generally cylindrical configuration but tapers in opposite directions from an enlarged circumferentially extending ridge 48, the cross-sectional dimension of which is somewhat larger than that of the apertures 42. A grove 50 extends axially along one side of the shank portion 46, and permits limited compressibility so as to enable reduction of the effective cross-sectional dimension thereat. An enlarged head 52 is provided at one end, and is spaced from the ridge 48 a distance slightly greater than the combined thickness of the brace piece 36 and one of the lateral walls 34 of the channel piece 28. As a result, when the fastener 44 is fully inserted the ridge 48 will extend beyond the farther face of the brace piece, and will expand (from the compressed state assumed within the aperture 42) to produce a snap-fit engagement thereagainst.

The rear end face of the brace piece 36 is of complex configuration, and includes a rectilinear section 54 which intersects the top face 38 at a right angle thereto, and a curvilinear section 56 downwardly therefrom. Thus, the back portion of the brace piece has a contoured end face with an outermost upper section 54, disposed adjacent the top face 38, and an infinite number of lower elements therebelow (provided by increments of the curved section 56) which are spaced inwardly from the axis of the rectilinear element 54, the spacing increasing progressively with the distance of any given element from the axis of the top face.

Figure 4:
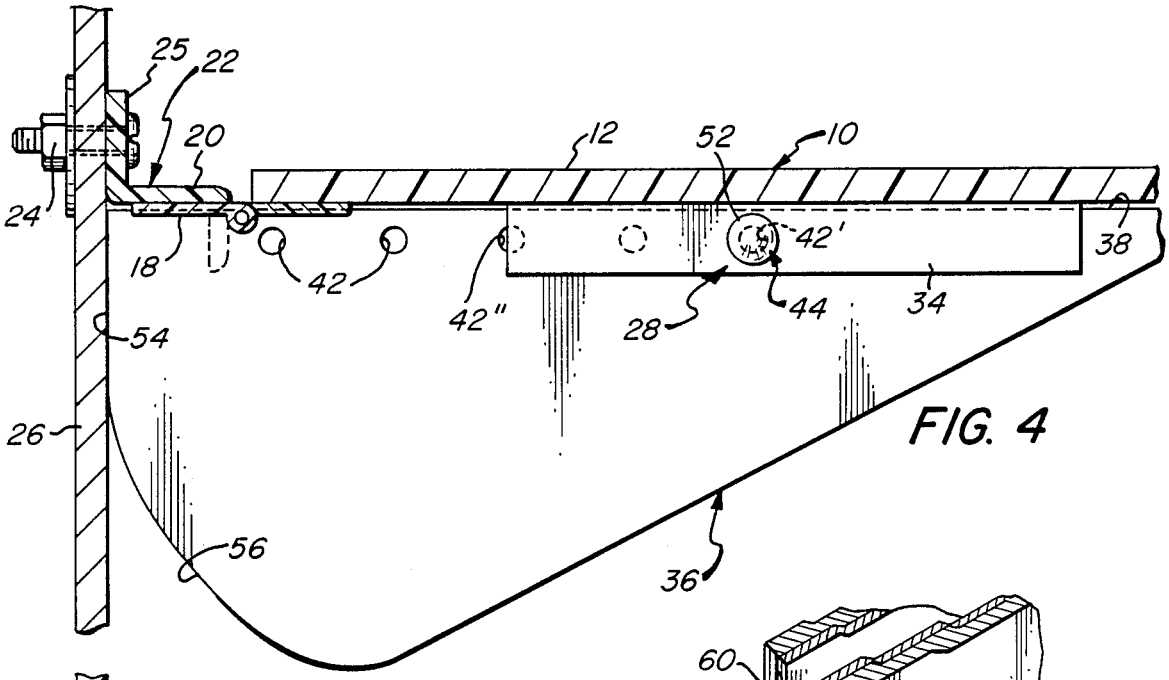
FIG. 4 is a fragmentary side view of the system of FIG. 1, drawn to an enlarged scale and taken in partial section, with the shelf supported horizontally.

Because of this end face configuration, when the pieces 36, 28 are affixed by the fastener 44 in a relative position in which the forwardmost aperture 42' is aligned with the apertures 32, the rectilinear section 54 on the rear end face will lie in the direct contact with the surface of the wall 26 below the angle member 22. This will dispose the shelf 10 with its main body portion 12 perpendicular to the wall, as depicted in FIG. 4; the wall 26 will of course normally be vertical, and the shelf portion 12 will therefore be disposed at a horizontal attitude.

Figure 5:
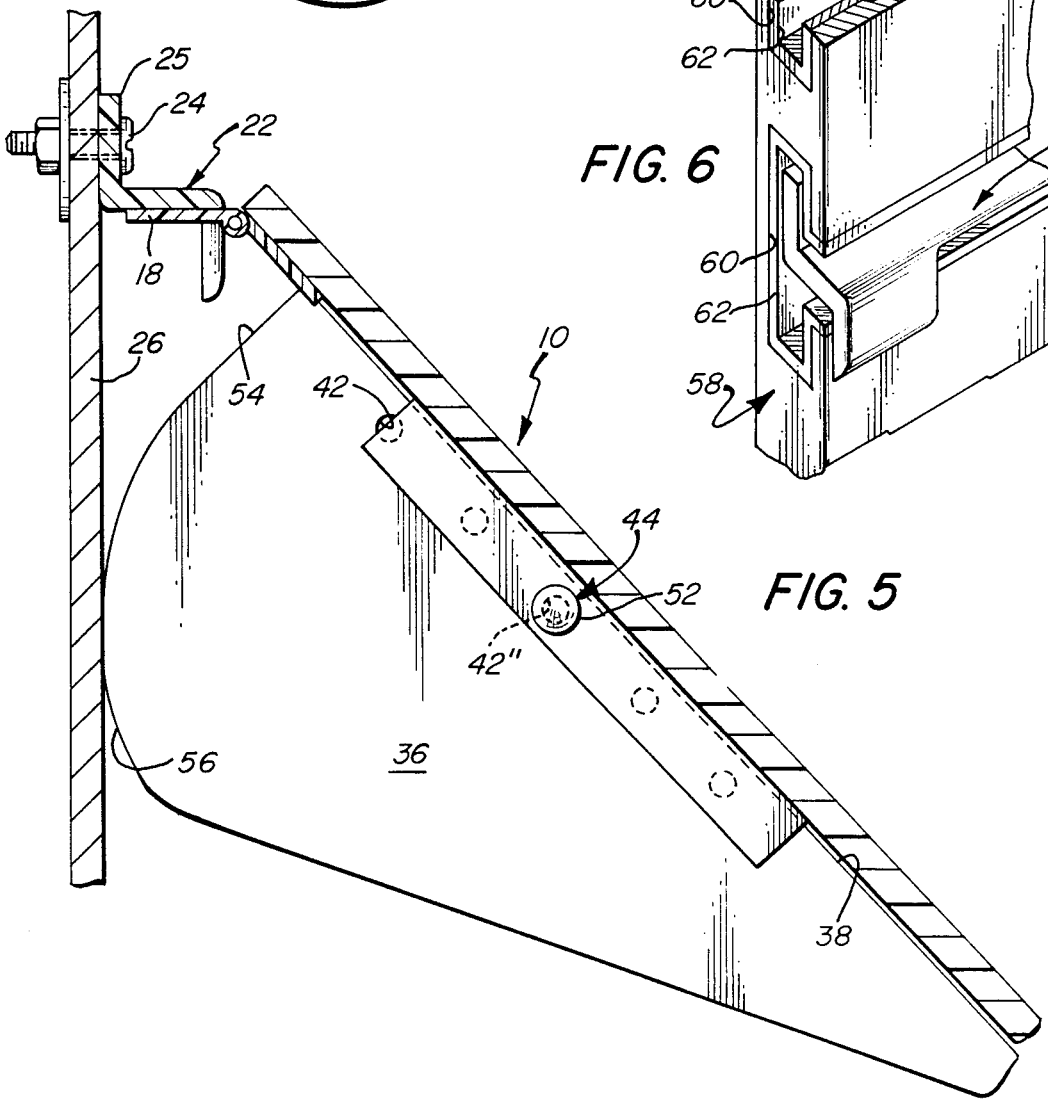
FIG. 5 is a view similar to FIG. 4, with the shelf supported at an orientation of approximately 45° to horizontal.

Securing the brace piece 36 in a forwardly shifted position, with the central aperture 42" aligned with the apertures 32, will permit the shelf 10 to assume a downwardly inclined position in which elements of the curvilinear face section 56 contact the wall; this relationship is illustrated in FIG. 5, wherein the shelf is oriented approximately 45° to horizontal. As will the readily evident, affixing the brace piece in the three positions enabled by the remaining apertures will permit orientation of the shelf in other oblique attitudes; typically, they will be 15°, 30° and 60°, and the spacing of the apertures 42 will be selected to produce any desired pitch of the shelf.

Figure 6:
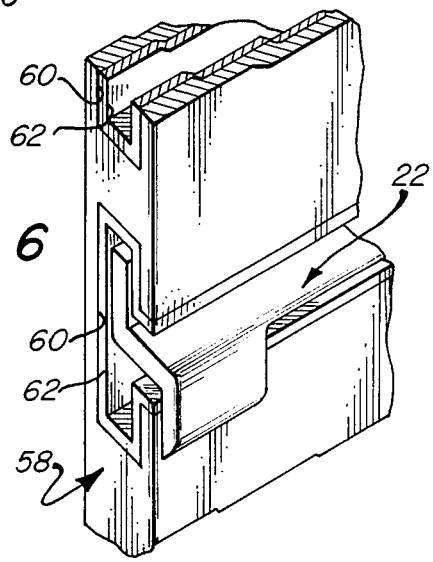
FIG. 6 is a fragmentary perspective view showing the manner in which the shelf system of the invention can be mounted upon a slat wall.

FIG. 6 illustrates the manner by which the shelf system can be supported on a slot wall 58; this capability may be especially important in view of the prevalance of such wall structure in contemporary commercial use. As is conventional, one face of the wall 58 is formed with a pattern of horizontally extending parallel slots 60 (normally of T-shaped cross section), within which are seated aluminum liners 62, which may be of either T-shaped (a illustrated) or L-shaped cross section. Attachment of the shelf system to the wall is achieved simply by inserting the leg 25 of the right-angle member 22 into the opening slit of the liner 62, to seat within the upper recess defined thereby and to engage behind the depending lip thereof, without need for added fasteners.

Although many different materials may be suitable for fabrication of the several components of the system, plastic construction will be preferred in many instances. By proper selection of the material, the fasteners employed will inherently exhibit an appropriate level of resiliency to enable facile insertion and yet secure interengagement of the pieces; nylon may advantageously be used. Permanent assembly of plastic parts can of course be readily be achieved by any suitable bonding technique, which may or may not entail the use of adhesives.

Typically, the shelves will measure about 12 to 32 inches wide, and 8 to 16 inches deep. If a bottom flange or lip portion is provided, it will usually be about 1½ to 6 inches high.

Many variations may of course be made in the particular form of the components of the system, without departing from the concepts of the invention. For example, although the compound rectilinear/curvilinear face configuration on the brace piece shown in the drawings provides the necessary contacting elements in a very desirable way, other contours may be found suitable; e.g., an edge face comprised of a series of angled surface components might be substituted. Also, the means by which the brace piece is secured to the mounting piece may be quite different; thus, clamp structure could be provided on the mounting piece for securing the brace piece, and thereby the shelf, throughout a range of positions. The system can be adapted for mounting on virtually any kind of supporting wall, including slat walls, flat walls, pegboard walls, grid systems, and the like. Other variations will readily occur to those skilled in the art.

Thus, it can be seen that the present invention provides a novel assembly for disposing a shelf, or the like, in each of a number of angular orientations. The assembly is comprised of only a few pieces, of uncomplicated and relatively inexpensive construction, which are readily adjusted relative to one another to provide secure support in each of a multiplicity of positions. Also provided is a novel wall shelf system which employs an assembly having the above-described features and advantages, and the assembly and system of the invention are relatively facile and inexpensive to manufacture.

Having thus described the invention, what is claimed is:

1. An assembly for supporting a bracket in each of a multiplicity of angular orientations, comprising: a brace piece having an upper portion with a substantially rectilinear top face extending along a first axis, and a back portion with a contoured end face, said end face having an upper element that is outermost on said brace piece and that lies adjacent said first axis on a second axis that is perpendicular thereto, and said end face having a plurality of lower elements below said upper element and accessible for direct contact on an adjacent flat surface, said lower elements being spaced inwardly from said second axis by distances that increase progressively with increasing distance from said first axis, so that any one of said lower elements that is disposed further from said first axis than any other of said lower elements will also be spaced further from said second axis than is said other lower element; a mounting piece said upper portion said brace piece in each of a multiplicity of relative position along said top face; and means for disengageably affixing said brace piece to said mounting piece in each of said relative positions.

2. The assembly of claim 1 wherein said upper element of said end face is elongated and extends substantially rectilinearly along said second axis, and wherein said top face and said upper element intersect to form a right-angle section on said brace piece.

3. The assembly of claim 1 wherein said end face includes a curvilinear section by which said lower elements are provided.

4. The assembly of claim 1 wherein said upper portion of said brace piece has a multiplicity of apertures formed therethrough along said top face, and wherein said mounting piece has an element for slidably engaging said top face, and also has elements which cooperate with said apertures for securing said pieces in said relative positions.

5. The assembly of claim 4 wherein said securing elements of said mounting piece comprise spaced flange elements projecting from said engaging element and defining a channel therebetween for slidably engaging said upper portion of said brace piece, wherein said flange elements have aligned apertures therethrough located to align with each of said apertures of said brace piece in said relative positions, and wherein said affixing means comprises a fastener having a shank for extending through said apertures of both of said pieces when aligned with one another.

6. The assembly of claim 5 wherein said mounting piece comprises an elongated channel member of generally U-shaped cross section.

7. The assembly of claim 5 wherein said shank of said fastener has an enlarged section along its length which is resiliently compressible so as to reduce its effective external cross sectional dimensions, said enlarged section having, in its uncompressed state, a cross-sectional dimension larger than the cross sectional dimensions of said apertures of at least one of said brace piece and said flange elements to afford a snap-fit interengagement therewith.

8. The assembly of claim 7 wherein said shank is hollow along a portion of its length, and wherein said fastener has a head at one end of said shank spaced from said enlarged section thereof.

9. A wall shelf system, including a shelf and at least one supporting assembly disposed on a bottom surface thereof, said supporting assembly comprising: a brace piece having an upper portion with a substantially rectilinear top face extending along a first axis, and a back portion with a contoured end face, said end face having an upper element that is outermost on said brace piece and that lies adjacent said first axis on an axis that is perpendicular thereto, and said end face having a plurality of lower elements below said upper element and accessible for direct contact on an adjacent flat surface, said lower elements being spaced inwardly from said second axis by distances that increase progressively with increasing distance from said first axis, so that any one of said lower elements that is disposed further from said first axis than any other of said lower elements will also be spaced further from said second axis than is said other lower element; a mounting piece said upper portion of said brace piece in each of a multiplicity of relative positions along said top face; and means for disengageably affixing said brace piece to said mounting piece in each of said relative positions, said mounting piece of said supporting assembly being secured to a bottom surface of said shelf.

10. The system of claim 9 wherein said shelf comprises a main panel portion and a ledge portion extending upwardly therefrom along a first edge thereof.

11. The system of claim 10 wherein said first edge is generally rectilinear, wherein said main panel portion has a second, generally rectilinear edge spaced from said first edge and substantially parallel thereto, and wherein said system additionally includes means adjacent said second edge of said panel portion for attachment to a wall or the like.

12. The system of claim 11 wherein said attachment means comprises at least one hinge member having a component secured to said panel portion.

13. The system of claim 12 wherein said attachment means includes an elongated mounting member extending along said second edge and being adapted for direct attachment to a wall or the like, said mounting member having a component of said hinge member secured thereto.

14. The system of claim 13 wherein said mounting member is comprised of two perpendicular legs and has a generally right angular cross-sectional configuration, and wherein said hinge member component is secured to one of said legs, the other of said legs being adapted for insertion into a slot of a slot wall for attachment thereto without need for added fasteners.

15. The system of claim 9 including a second said supporting assembly disposed on said bottom surface of said shelf and spaced laterally from said first-mentioned assembly.

* * * * *

UNITED STATES PATENT AND TRADEMARK OFFICE

CERTIFICATE OF CORRECTION

PATENT NO. : 4,730,738

DATED : March 15, 1988

INVENTOR(S) : John Bartus et al

It is certified that error appears in the above-identified patent and that said Letters Patent is hereby corrected as shown below:

Column 6, line 47, insert after "piece", -- having a back end, said mounting piece defining means for engaging --, line 48, insert after "face" -- for varying the distance, along said first axis, between said back end of said mounting piece and said upper element of said end face --.

Column 8, line 2, insert after "piece" -- having a back end, said mounting piece defining means for engaging --; line 4, insert after "face" -- for varying the distance, along said first axis, between said back end of said mounting piece and said upper element of said end face --.

Signed and Sealed this

Twelfth Day of July, 1988

*Attest:*

DONALD J. QUIGG

*Attesting Officer*

*Commissioner of Patents and Trademarks*